US007107977B2

(12) United States Patent
Kojima et al.

(10) Patent No.: US 7,107,977 B2
(45) Date of Patent: Sep. 19, 2006

(54) IGNITION APPARATUS FOR INTERNAL COMBUSTION ENGINE

(75) Inventors: Masami Kojima, Chiryu (JP); Shunichi Takeda, Nagoya (JP); Koukichi Yamada, Sanda (JP); Atushi Moriyama, Sanda (JP)

(73) Assignees: Denso Corporation, Kariya (JP); Hanshin Electric Co., Ltd., Kobe (JP)

( * ) Notice: Subject to any disclaimer, the term of this patent is extended or adjusted under 35 U.S.C. 154(b) by 0 days.

(21) Appl. No.: 11/347,281

(22) Filed: Feb. 6, 2006

(65) Prior Publication Data

US 2006/0174858 A1 Aug. 10, 2006

(30) Foreign Application Priority Data

Feb. 4, 2005 (JP) ..... 2005-029221

(51) Int. Cl.
*F02P 3/055* (2006.01)
*H01F 38/12* (2006.01)

(52) U.S. Cl. ..... 123/647; 123/633; 123/654; 123/656

(58) Field of Classification Search ..... 123/633, 123/647, 651, 652, 654, 656; 315/209 T; 439/126
See application file for complete search history.

(56) References Cited

U.S. PATENT DOCUMENTS 3,824,441 A * 7/1974 Heyman et al. ..... 363/37
4,005,343 A * 1/1977 Lamprecht ..... 361/256
4,304,212 A * 12/1981 Rivoal et al. ..... 123/647
5,111,233 A * 5/1992 Yokonuma et al. ..... 315/241 P
5,345,166 A * 9/1994 Leonard et al. ..... 323/324
5,376,874 A * 12/1994 Ramme ..... 320/160
5,418,702 A * 5/1995 Marinus et al. ..... 363/16
5,559,656 A * 9/1996 Chokhawala ..... 361/18
5,740,787 A 4/1998 Ando ..... 123/635
5,796,183 A * 8/1998 Hourmand ..... 307/116
6,255,890 B1 * 7/2001 Aiello et al. ..... 327/432

FOREIGN PATENT DOCUMENTS

JP 6-317243 11/1994
JP 10-274142 10/1998

* cited by examiner

*Primary Examiner*—T. M. Argenbright
(74) *Attorney, Agent, or Firm*—Nixon & Vanderhye P.C.

(57) ABSTRACT

An ignition apparatus for an internal combustion engine, which is controlled by a control unit, includes a connector, an ignition coil assembly, an igniter and a capacitor. The connector is electrically connected with the control unit, and includes an input terminal, which is electrically connected with the control unit to receive an ignition signal outputted by the control unit. The connector also includes a ground terminal, which is connected with a ground. The igniter includes a switching device that switches a coil current supplied to the ignition coil assembly based on the ignition signal received from the control unit through the connector. The igniter also includes a Zener diode that serves as a protection element of the switching device. The capacitor is provided in parallel with the Zener diode between the input terminal and the ground terminal to form a parallel circuit.

5 Claims, 4 Drawing Sheets

IGNITION APPARATUS FOR INTERNAL COMBUSTION ENGINE

CROSS REFERENCE TO RELATED APPLICATION

This application is based on and incorporates herein by reference Japanese Patent Applications No. 2005-29221 filed on Feb. 4, 2005.

BACKGROUND OF THE INVENTION

1. Field of the Invention

The present invention relates to an ignition apparatus for an internal combustion engine having an igniter.

2. Description of Related Art

Conventionally, an ignition apparatus having an igniter has been disclosed to control ignition timing of an internal combustion engine (hereinafter, referred as an engine) by controlling primary current of the ignition coil assembly (see Japanese Unexamined Patent Publication No. H6-317243).

As shown in a circuit diagram in FIG. 6, in the ignition apparatus, a switching device 100, which regulates switching a coil current supplied to an ignition coil assembly 400, is connected with a Zener diode 200, which is a protection element for protecting an igniter 300 from an external surge. The igniter 300 includes the switching device 100 and the Zener diode 200.

Specifically, a cathode of the Zener diode 200 is connected to an input terminal 10, to which an ignition signal is inputted, and an anode of the Zener diode 200 is connected to a ground (GND) terminal 20, which is connected to a ground. Here, the ignition signal is inputted to the switching device 100 through the input terminal 10. A battery terminal 30 is connected to a battery. In the above connection state, a voltage-clamp function of the Zener diode 200 protects the switching device 100 from being applied with a high voltage even when the external surge is generated.

Recently, in some cases, the ignition apparatus having the igniter is mounted above a corresponding one of cylinders of the engine. Therefore, a length of a signal wire electrically connecting between the ignition apparatus and an engine control unit (ECU) may be increased, and as a result, a wire capacity of the signal wire may become larger.

In this state, a positive potential is selectively stored in the wire capacity by rectification of the Zener diode 200 in a circuit with the Zener diode 200 as shown in FIG. 6 when a radio current is generated around the signal wire by a strong electric field due to a broadcast station and a radio equipment. Then, a potential level, which is supposed to indicate a low level of an ignition input signal inputted to the ignition apparatus through the input terminal 10, is falsely increased to exceed a proper value for the low level of the ignition signal. Then, the igniter 300 falsely turns on the switching device 100 based on a false signal with the false potential level, and this may result in falsely operating the ignition apparatus.

SUMMARY OF THE INVENTION

It is therefore an object of the present invention to provide an ignition apparatus, which obviates or mitigates at least one of the above disadvantages.

To achieve the objective of the present invention, there is provided an ignition apparatus for an internal combustion engine, which is controlled by a control unit. The ignition apparatus includes a connector, an ignition coil assembly, an igniter and a capacitor. The connector is electrically connected with the control unit, and includes an input terminal, which is electrically connected with the control unit to receive an ignition signal outputted by the control unit. The connector also includes a ground terminal, which is connected with a ground. The ignition coil assembly is connected with the connector. The igniter includes a switching device that switches a coil current supplied to the ignition coil assembly based on the ignition signal received from the control unit through the connector. The igniter also includes a Zener diode that serves as a protection element of the switching device. Here, the Zener diode is provided between the input terminal and the ground terminal. The capacitor is provided in parallel with the Zener diode between the input terminal and the ground terminal to form a parallel circuit.

To achieve the objective of the present invention, there is also provided an ignition apparatus for an internal combustion engine, which is controlled by a control unit. The ignition apparatus includes a connector, an ignition coil assembly, an igniter and an inductance coil. The connector is electrically connected with the control unit, and includes an input terminal, which is electrically connected with the control unit to receive an ignition signal outputted by the control unit. The connector also includes a ground terminal, which is connected with a ground. The ignition coil assembly is connected with the connector. The igniter includes a switching device that switches a coil current supplied to the ignition coil assembly based on the ignition signal received from the control unit through the connector. The igniter also includes a Zener diode that serves as a protection element of the switching device. Here, the Zener diode is provided between the input terminal and the ground terminal. The inductance coil is connected between the input terminal and the Zener diode.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

An ignition apparatus for a vehicle according to a first embodiment of the present invention will be described with reference to the accompanying drawings.

Figure 1:
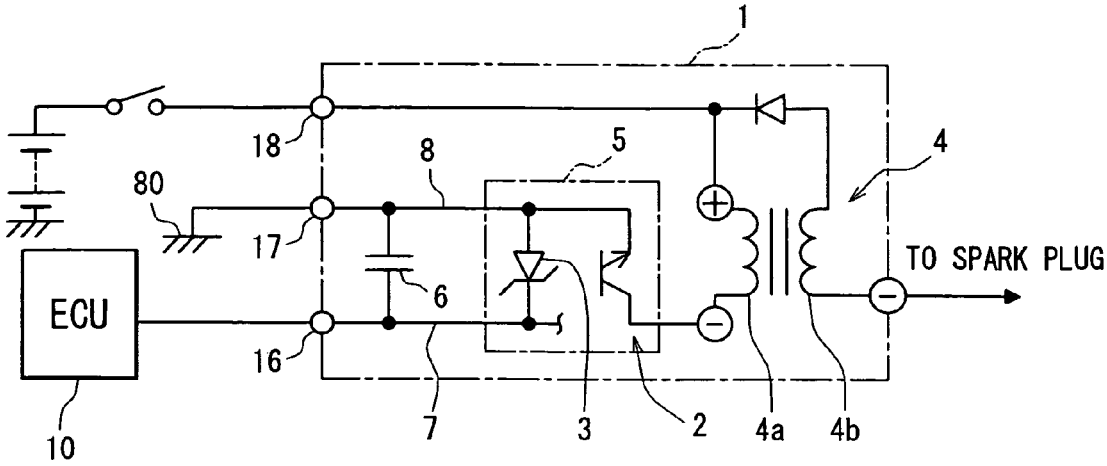
FIG. 1 is a circuit diagram of an ignition apparatus according to a first embodiment of the present invention.
Figure 3:
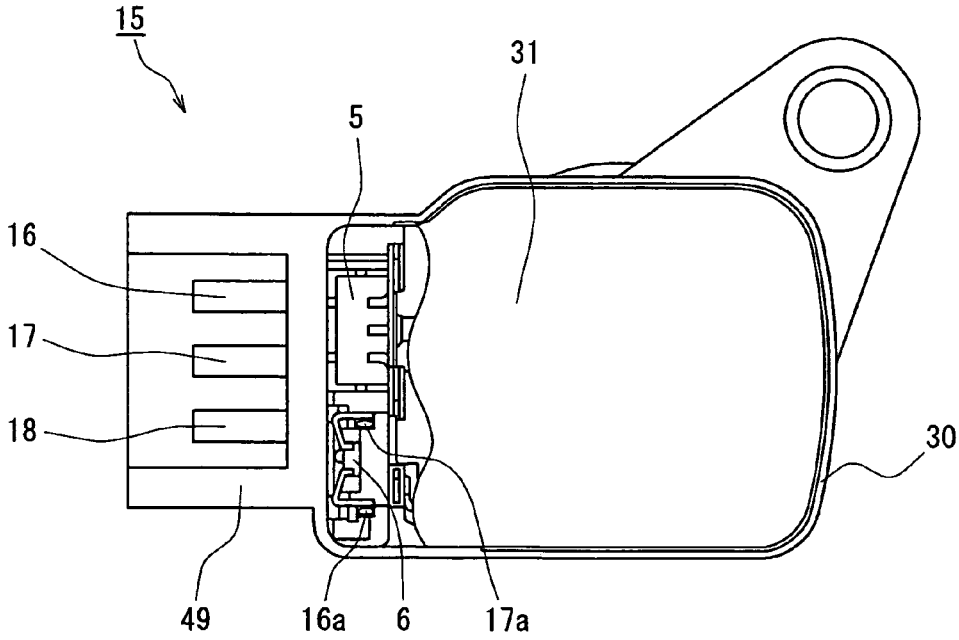
FIG. 3 is a top view of the ignition apparatus shown in FIGS. 1 and 2.
Figure 2:
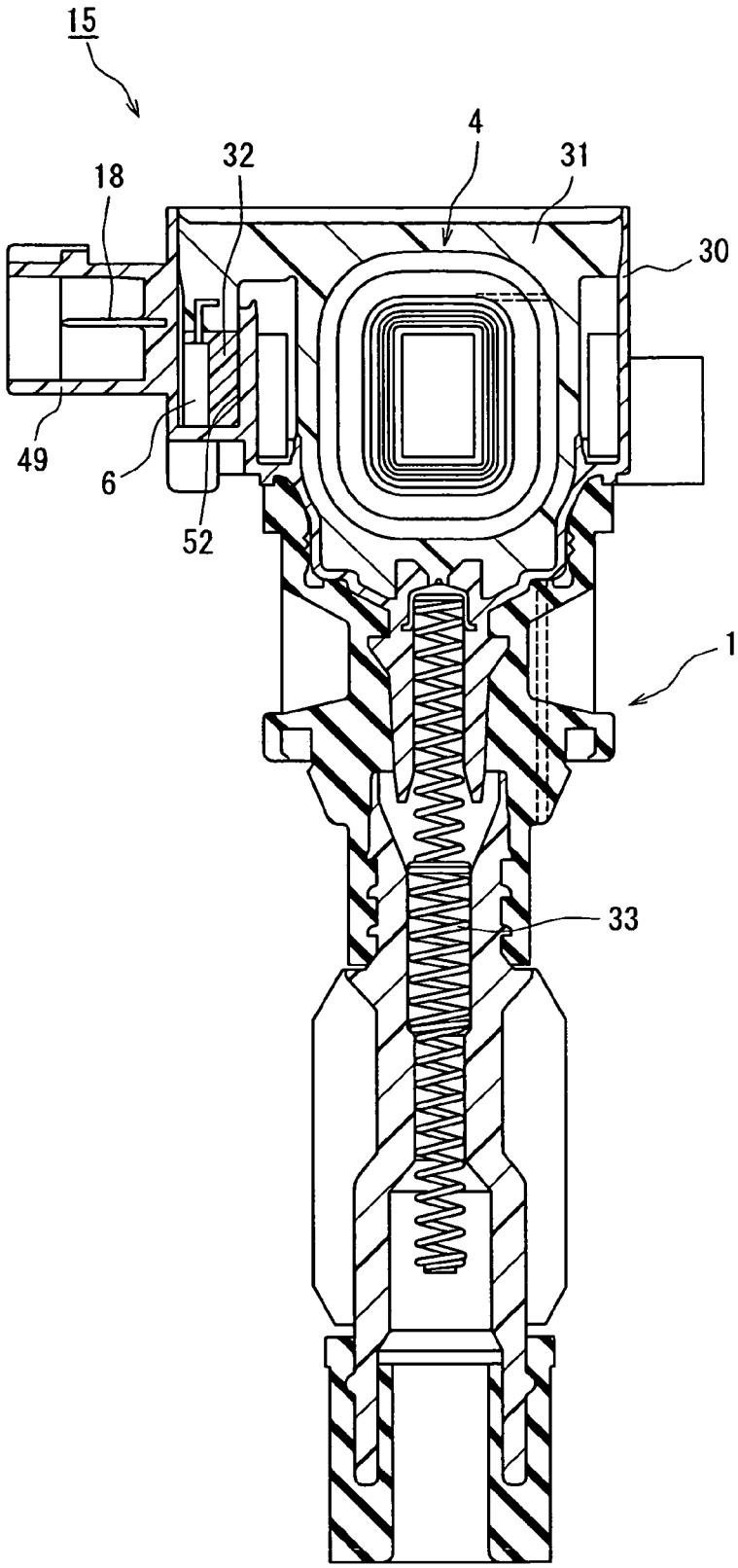
FIG. 2 is a sectional view of the ignition apparatus shown in FIG. 1.
Figure 4A:
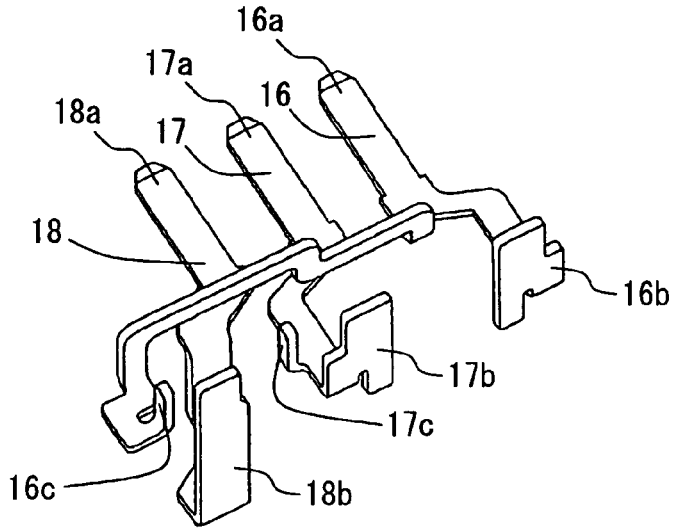
FIG. 4A is a perspective view showing terminals of a connector of the ignition apparatus shown in FIGS. 1 and 2.
Figure 4B:
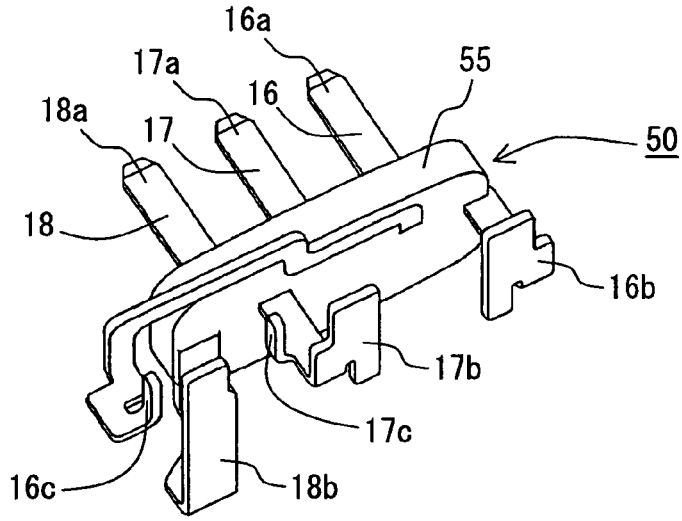
FIG. 4B is a perspective view showing a premolded body of the terminals shown in FIG. 4A.
Figure 4C:
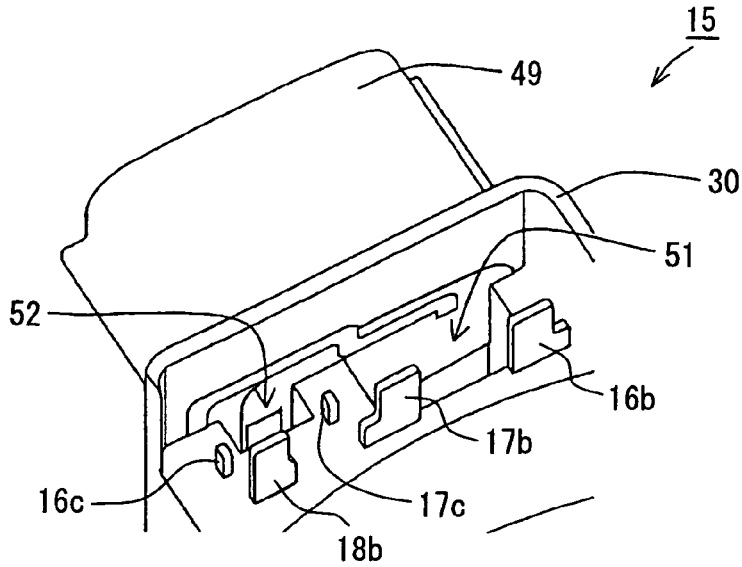
FIG. 4C is a perspective view showing the connector shown in FIG. 4A.

FIG. 1 is a circuit diagram of an ignition apparatus 1 according to the first embodiment. FIG. 2 is a sectional view of the ignition apparatus 1 according to the first embodiment. FIG. 3 is a top view of the ignition apparatus 1 according to the first embodiment. FIGS. 4A to 4C explain a molding process of a connector 15 of the ignition apparatus 1 according to the first embodiment.

The ignition apparatus 1 includes an ignition coil assembly 4 and an igniter 5 as shown in FIG. 1.

The igniter 5 includes a switching device 2 for performing a switching control of primary current of a primary winding 4*a* included in the ignition coil assembly 4.

A gate of the switching device 2 is connected to an input wire 7 of the igniter 5 such that an ignition input signal (ignition signal) outputted by an engine control unit (ECU) 10 for controlling an internal combustion engine (not illustrated) is inputted to the gate of the switching device 2. When a potential level of a gate potential of the switching device 2 becomes a high level, a switching element of the switching device 2 is turned on so that the primary winding 4*a* of the ignition coil assembly 4 is energized. When the potential level of the gate potential becomes a low level, the switching element is turned off so that the primary current of the primary winding 4*a* is stopped.

The igniter 5 further includes a Zener diode 3, which serves as a protection element. A cathode terminal of the Zener diode 3 is connected to an input line provided inside the igniter 5. The input line is electrically conducting to the input wire 7, to which the ignition signal is inputted from the ECU 10. In contrast, an anode terminal of the Zener diode 3 is connected to a ground line provided inside the igniter 5. The ground line is electrically conducting to a ground wire (GND wire) 8, which is connected to the igniter 5. The Zener diode 3 limits the switching device 2, which switches a coil current supplied to the ignition coil assembly 4, from damages due to an external surge.

Furthermore, the ignition apparatus 1 includes a parallel circuit, which has a capacitor 6 connected between the input wire 7 and the GND wire 8.

Here, the connector 15 includes three terminals (i.e., an input terminal 16, a ground (GND) terminal 17 and a battery terminal 18). The input wire 7 is electrically connected to the input terminal 16. Likewise, the GND wire 8 is electrically connected to the GND terminal 17. The input terminal 16 is connected to the ECU 10 through the signal wire, and the GND terminal 17 is electrically grounded to a ground (GND) 80 through a harness (not illustrated). The three terminals 16 to 18 of the connector 15 will be descried in details later.

The ignition apparatus 1 having the above-described circuit will be specifically described with reference to the sectional view in FIG. 2 and the top view in FIG. 3.

The ignition coil assembly 4 of the ignition apparatus 1 is accommodated inside a coil case 30, which is made of a resin. The coil case 30 has an opening portion on an upper side thereof as shown in FIG. 2. The ignition coil assembly 4 is accommodated through the opening portion of the coil case 30. The igniter 5 (shown in FIG. 3) and the capacitor 6 are also accommodated in the coil case 30, and are located between the ignition coil assembly 4 and the connector 15 that is formed integrally with the coil case 30. The connector 15 has the three terminals for electrically connecting with external portions as described in details later. The coil case 30 is filled with an epoxy resin 31 in a state where the three terminals 16 to 18 are electrically connected with the igniter 5, the capacitor 6 and the ignition coil assembly 4 in such a manner that the ignition coil assembly 4 is dielectrically supported inside the coil case 30.

It is noted that before the epoxy resin 31 is supplied, a silicone adhesive 32 is supplied to fully cover the igniter 5 and the capacitor 6, both of which are accommodated in the coil case 30 and are electrically connected. The silicone adhesive 32 can mitigate stresses (e.g., a thermal stress) against the igniter 5 and the capacitor 6.

A spring 33 is located on a lower side of the ignition coil assembly 4 as shown in FIG. 2. The spring 33 is connected to a secondary winding 4*b* included in the ignition coil assembly 4, and is also connected to a spark plug (not illustrated).

Next, the molding process of the connector 15 will be described with reference to FIGS. 4A to 4C.

As shown in FIG. 4A, the three terminals 16 to 18, which will be integrally supported by the connector 15, are three metal members. External ends of the three terminals 16 to 18 serve as external terminal portions 16*a*, 17*a*, 18*a* and are formed into plate shapes. The three terminals 16 to 18 are arranged in parallel. One end of the input terminal 16 is an ignition signal input terminal portion 16*a*, which is connected with the ECU 10 through the signal wire. One end of the GND terminal 17 is a GND terminal portion 17*a*, which is connected to the external grounding (e.g., the GND 80). One end of the battery terminal 18 is a battery terminal portion 18*a*, which is connected to a battery.

The other ends of the three terminals 16 to 18 extend, and become internal terminal portions 16*b*, 17*b*, 18*b*, 16*c*, 17*c* for predetermined connections inside the ignition apparatus 1.

The other end of the input terminal 16, which is opposite from the ignition signal input terminal portion 16*a*, is formed into a bent portion 16*b*, which is bent upwardly as shown in FIGS. 4A to 4C. Through the bent portion 16*b*, the input terminal 16 is connected with the input wire 7, which is connected to the igniter 5 in the ignition apparatus 1, as described before. Further, the other end of the input terminal 16 branches off to form a projection, which serves as a capacitor connection terminal portion 16*c*, for connecting with the capacitor 6. Likewise, the other end of the GND terminal 17, which is opposite from the GND terminal portion 17*a*, is formed into a bent portion 17*b*, which is bent upwardly as shown in FIGS. 4A to 4C. Through the bent portion 17*b*, the GND terminal 17 is connected with the GND wire 8, which is connected to the igniter 5 in the ignition apparatus 1, as described before. A projection, which serves as a capacitor connection terminal portion 17*c* for connecting with the capacitor 6, is formed in the middle of the GND terminal 17.

The other end of the battery terminal 18, which is opposite from the battery terminal portion 18*a*, is also formed into a bent portion 18*b*.

The three terminals 16 to 18 formed as described above are integrally insert molded into a resin (or a dielectric body) 55 to form a premolded body 50 as shown in FIG. 4B in such a manner that the three terminals 16 to 18 are arranged as shown in FIG. 4A.

Then, the premolded body 50, which is made by insert molding the three terminals 16 to 18 into the resin 55, is set in a predetermined mold, and is supplied with a resin (or a dielectric body) 49 to be formed into the connector 15 of the ignition apparatus 1 as shown in FIG. 4C. Here, the resin 49 of the connector 15 includes the resin 55 of the premolded body 50. At the same time, the coil case 30 is formed with the resin 49.

The connector 15 is formed with the resin 49 in such a manner that the capacitor connection terminal portions 16*c*, 17*c* of the terminals 16, 17 are exposed outside, and the bent portions 16*b*, 17*b*, 18*b* of the three terminals 16 to 18 are also partially exposed outside. Therefore, the capacitor connection terminal portions 16*c*, 17*c* and the bent portions 16*b*, 17*b*, 18*b* serve as the internal terminal portions to be electrically connected with the capacitor 6 and the igniter 5.

As discussed above, the connector 15 can be formed to have the multiple internal terminal portions 16*b*, 17*b*, 18*b*, 16*c*, 17*c* arranged at predetermined positions by the molding process, where the premolded body 50 is firstly formed and then the connector 15 is molded with the resin 49.

The capacitor connection terminal portions 16*c*, 17*c* and the bent portions 16*b*, 17*b*, 18*b* that are formed by bending the other ends of the three terminals 16 to 18 are firstly insert molded to form the premolded body 50. Then, the connector 15 is molded with the resin 49 to form the internal terminal portions 16*b*, 17*b*, 18*b*, 16*c*, 17*c* for the igniter 5 and the capacitor 6. Therefore, the internal terminal portions 16*b*, 17*b*, 18*b*, 16*c*, 17*c*, which are positioned with a sufficient degree of accuracy, can be formed, and it becomes easy to achieve a reliable electrical connection when the igniter 5 and the capacitor 6 are mounted.

Also, as shown in FIG. 4C, an igniter accommodating portion 51, which accommodates the igniter 5, is formed as a recess simultaneously with the forming of the connector 15. Also, a capacitor accommodating portion 52, which accommodates the capacitor 6 is formed as a recess. A width of the igniter accommodating portion 51 is determined to correspond to a width of the igniter 5. Likewise, a width of the capacitor accommodating portion 52 is determined to correspond to a width of the capacitor 6. Therefore, unstable electrical connection due to unfitted positioning of the igniter 5 or the capacitor 6 is avoided when the igniter 5 or the capacitor 6 is accommodated in the corresponding accommodating portion 51 or 52.

Owning to the structure of the accommodating portion, the secure electrical connection can be achieved when the igniter 5 or the capacitor 6 is mounted.

The ignition apparatus 1 is constituted as described above. A collector of the switching element included in the switching device 2 is connected with the primary winding 4*a* of the ignition coil assembly 4, and at the same time the secondary winding 4*b* of the ignition coil assembly 4 is connected with the spark plug. Therefore, the ignition apparatus 1 can apply a high voltage to the spark plug.

The ignition apparatus 1 is controlled based on the ignition input signal (ignition signal) inputted by the ECU 10 through the signal wire, which is externally connected to the connector 15. When the ignition signal becomes a high level, a high gate voltage is applied to the switching element such that the switching element becomes ON state. Then, a current flows between the collector and an emitter of the switching element so that a coil current flows through the primary winding 4*a* of the ignition coil assembly 4. In contrast, when the ignition signal from the ECU 10 becomes a low level, the gate voltage of the switching element is reduced so that the switching element becomes OFF state. Therefore, the coil current to the primary winding 4*a* of the ignition coil assembly 4 is stopped.

An above-described switching control of the switching element controls the coil current supplied to the primary winding 4*a* such that a necessary amount of the current is supplied to the spark plug through the secondary winding 4*b*, and the ignition takes place in the engine.

In the above-described structure of the ignition apparatus 1, a radio current, which is generated by the strong electric field, at the signal wire connecting between the ECU 10 and the ignition apparatus 1 bypasses the Zener diode 3 through the capacitor 6. This is because the capacitor 6 is provided in the parallel circuit inside the connector 15. Therefore, rectification of the Zener diode will not take place.

As a result, the conventional disadvantage, where the potential level of the above-described signal wire may become a false potential level due to an influence of the strong electric field, is limited, and the igniter 5 is prevented from receiving a false signal with the false potential level. Thus, this limits a false operation of the ignition apparatus 1, where the switching element is mistakenly turned on.

In order to achieve the above-described effect, a capacity of the capacitor 6 is required to be at least 1000 pF, and experiments by the inventors identify that the capacity of the capacitor 6 is preferably 2200 pF when an ignition delay is took into consideration.

Second Embodiment

A second embodiment of the present invention will be described with reference to the accompanying drawings. Similar components of a ignition apparatus of the second embodiment, which are similar to the components of the ignition apparatus of the first embodiment, will be indicated by the same numerals. The present embodiment describes an embodiment, where the parallel circuit of the connector 15 according to the first embodiment is replaced with a series circuit. However, the other structure except for the above-described replacement is similar to the first embodiment, and therefore only different parts will be described.

Figure 5:
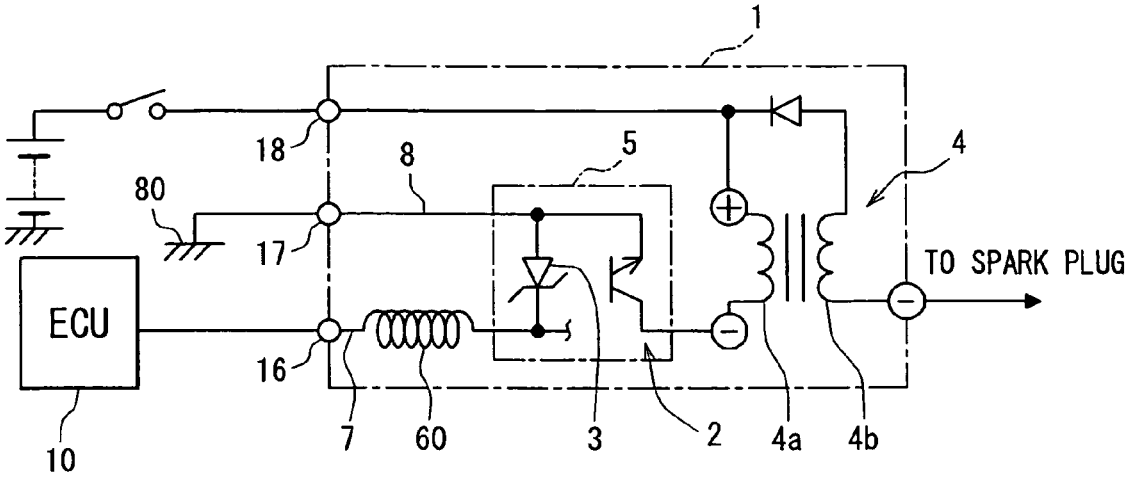
FIG. 5 is a circuit diagram of an ignition apparatus according to a second embodiment of the present invention.
Figure 6:
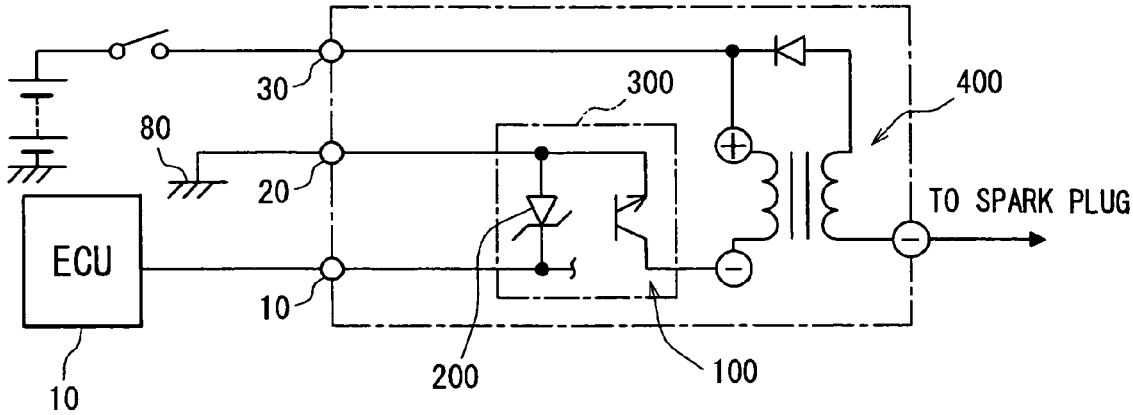
FIG. 6 RELATED ART
FIG. 6 is a circuit diagram of a conventional ignition apparatus.

FIG. 5 is a circuit diagram of an ignition apparatus 1 according to the second embodiment. As shown in FIG. 5, an inductance coil 60 is provided in series on the input wire 7, which is connected to the igniter 5.

With this structure, the radio current, which is generated by the strong electric field, at the signal wire connecting between the ECU 10 and the ignition apparatus 1 is limited from being supplied to the igniter 5 owning to an impedance of the inductance coil 60. As a result, the conventional disadvantage, where the potential level of the above-described signal wire may become the false potential level due to the influence of the strong electric field, is limited, and the igniter 5 is prevented from receiving the false signal with the false potential level. Thus, this limits the false operation of the ignition apparatus 1, where the switching element is mistakenly turned on.

The above-described embodiment shows an example, where the Zener diode 3 is provided between the input wire 7 to the igniter 5 and the GND 80. However, the Zener diode 3 is alternatively replaceable with a general diode.

Also, the above-described embodiment shows an example, where the capacitor 6 and the inductance coil 60 are provided outside the igniter 5. However, the capacitor 6 or the inductance coil 60 may be alternatively provided inside the igniter 5.

Further, the above-described embodiment shows an example, where the Zener diode 3 located between the input wire 7, which is connected to the igniter 5 and the GND 80 is provided inside the igniter 5. However, the Zener diode 3 or the general diode may be alternatively provided outside the igniter 5. Additional advantages and modifications will readily occur to those skilled in the art. The invention in its broader terms is therefore not limited to the specific details, representative apparatus, and illustrative examples shown and described.

What is claimed is:

1. An ignition apparatus for an internal combustion engine, which is controlled by a control unit, the ignition apparatus comprising:

a connector that is electrically connected with the control unit and includes:

an input terminal, which is electrically connected with the control unit to receive an ignition signal outputted by the control unit; and a ground terminal, which is connected with a ground;

an ignition coil assembly that is connected with the connector;

an igniter that includes:

a switching device that switches a coil current supplied to the ignition coil assembly based on the ignition signal received from the control unit through the connector; and a Zener diode that serves as a protection element of the switching device, wherein the Zener diode is provided between the input terminal and the ground terminal; and a capacitor that is provided in parallel with the Zener diode between the input terminal and the ground terminal to form a parallel circuit.

2. The ignition apparatus according to claim 1, wherein:

the connector includes a dielectric body;

the input terminal and the ground terminal are insert molded into the dielectric body;

the input terminal includes a first capacitor connection terminal portion that is connected with the capacitor; and the ground terminal includes a second capacitor connection terminal portion that is connected with the capacitor.

3. The ignition apparatus according to claim 2, wherein the connector further includes a capacitor accommodating portion, which is formed as a recess and accommodates the capacitor.

4. The ignition apparatus according to claim 3, wherein the capacitor is covered with a silicone.

5. An ignition apparatus for an internal combustion engine, which is controlled by a control unit, the ignition apparatus comprising:

a connector that is electrically connected with the control unit and includes:

an input terminal, which is electrically connected with the control unit to receive an ignition signal outputted by the control unit; and a ground terminal, which is connected with a ground;

an ignition coil assembly that is connected with the connector;

an igniter that includes:

a switching device that switches a coil current supplied to the ignition coil assembly based on the ignition signal received from the control unit through the connector; and a Zener diode that serves as a protection element of the switching device, wherein the Zener diode is provided between the input terminal and the ground terminal; and an inductance coil that is connected between the input terminal and the Zener diode.

* * * * *